US005279928A

United States Patent [19]

Dedio et al.

[11] Patent Number: 5,279,928

[45] Date of Patent: Jan. 18, 1994

[54] METHOD FOR PROCESSING A PHOTOTHERMOGRAPHIC ELEMENT

[75] Inventors: Edward L. Dedio, Pittsford; Gordon D. Young, Macedon, both of N.Y.

[73] Assignee: Eastman Kodak Company, Rochester, N.Y.

[21] Appl. No.: 982,926

[22] Filed: Nov. 30, 1992

[51] Int. Cl.[5] ..... G03C 1/498

[52] U.S. Cl. ..... 430/351; 430/352; 430/353; 430/619

[58] Field of Search ..... 430/352, 350, 351, 353, 430/348, 336, 619

[56] References Cited

U.S. PATENT DOCUMENTS

| | | | |
|---|---|---|---|
| 2,168,971 | 8/1939 | Capstaff | 430/350 |
| 3,457,075 | 7/1969 | Morgan et al. | 430/350 |
| 3,802,888 | 4/1974 | Willits | 430/351 |
| 3,933,508 | 1/1976 | Ohkubo et al. | 430/523 |
| 3,997,346 | 12/1976 | Masuda et al. | 430/352 |
| 4,352,872 | 10/1982 | Reece | 430/523 |
| 4,450,229 | 5/1984 | Reece | 430/523 |
| 4,741,992 | 5/1988 | Przezdziecki | 430/523 |
| 4,857,439 | 8/1989 | Dedio et al. | 430/349 |

*Primary Examiner*—Charles L. Bowers, Jr.
*Assistant Examiner*—John A. McPherson
*Attorney, Agent, or Firm*—Alfred P. Lorenzo

[57] ABSTRACT

A photothermographic element comprising a photosensitive silver halide, an organic silver salt and a reducing agent in concentrations such that imagewise exposure to actinic radiation generates from the silver halide a catalyst which accelerates an image-forming reaction between the organic silver salt and the reducing agent is processed by a method comprising the steps of (1) imagewise-exposing the element to actinic radiation to form a latent image therein, (2) subjecting the imagewise-exposed element to a first heating step at a temperature and for a time sufficient to intensify the latent image but insufficient to produce a visible image, and thereafter (3) subjecting the element to a second heating step at a temperature and for a time sufficient to produce a visible image. This method of "thermal latensification" serves to greatly reduce the significant speed losses that were heretofore encountered with photothermographic elements when considerable time was allowed to lapse between exposure to actinic radiation and generation of the visible image by heating.

12 Claims, No Drawings

METHOD FOR PROCESSING A PHOTOTHERMOGRAPHIC ELEMENT

FIELD OF THE INVENTION

This invention relates in general to photothermography and in particular to an improved method for processing a photothermographic element. More specifically, this invention relates to a method of improving the latent image stability of photothermographic elements which greatly enhances the utility of such elements.

BACKGROUND OF THE INVENTION

Thermally processable imaging elements, including films and papers, for producing images by thermal processing are well known. These elements include photothermographic elements in which an image is formed by imagewise exposure to light followed by development by uniformly heating the element. Such elements typically include photosensitive silver halide, prepared in situ and/or ex situ, as a photosensitive component, in combination with an oxidation-reduction image forming combination, such as silver behenate with a phenolic reducing agent. Such elements are described in, for example, *Research Disclosure, June,* 1978, Item No. 17029, U.S. Pat. No. 3,457,075; and U.S. Pat. No. 3,933,508.

Photothermographic elements are typically processed by a method which comprises imagewise exposure of the element to actinic radiation to form a latent image therein followed by heating of the imagewise-exposed element to convert the latent image to a visible image. The simplicity of this method is highly advantageous. One of the problems exhibited by such elements, however, is an inadequate degree of latent image keeping. Thus, in certain circumstances, it is very advantageous to be able to allow the lapse of considerable time between the imagewise-exposure step and the heating step which generates the visible image. However, because of the inadequate latent image keeping characteristics of photothermographic elements, speed losses of as much as 0.1 to 0.4 Log E, or more, can be encountered with elapsed times of, for example, one to twenty-four hours between the imagewise-exposure step and the heating step. Moreover, undesirable sensitometric changes such as loss of density and/or reduction in contrast can also take place. The speed loss and undesired sensitometric changes can be entirely avoided by use of a process in which the element is subjected to the heating step immediately after it is subjected to the imagewise-exposure step. However, this severely limits the ability of the user to process the element in the most convenient manner.

Efforts have been made heretofore to improve the latent image-keeping characteristics of photothermographic elements. For example, U.S. Pat. No. 4,857,439, issued Aug. 15, 1989, to Edward L. Dedio and John W. Reeves describes the incorporation of an alkyl carboxylic acid in a photothermographic element for the purpose of increasing latent image stability. In the method described in the '439 patent, the element containing the alkyl carboxylic acid is subjected to a heating step before imagewise exposure to light. The reaction that occurs in the element as a result of the heating step brings about the enhanced latent image stability. While this method is highly effective, it adds to the cost and complexity of the photothermographic element.

Other techniques for overcoming the problem of latent image instability in photothermographic elements have also been proposed. For example, U.S. Pat. No. 4,352,872, issued Oct. 5, 1982, to J. E. Reece describes the incorporation of diazepines in photothermographic elements to stabilize them against latent image fade, and U.S. Pat. No. 4,450,229, issued May 22, 1984, to J. E. Reece describes the use of certain diamines for the same purpose.

It is also known in the art to heat photothermographic elements prior to imagewise exposure to light for the purpose of imparting photosensitivity to the element (see, for example, U.S. Pat. Nos. 3,764,329, 3,802,888, 3,816,132 and 4,113,496). This technique, however, is not related to improvements in latent image-keeping characteristics.

It is toward the objective of providing a technique for enhancing the latent image stability of photothermographic elements without the need for incorporating special addenda therein that the present invention is directed.

SUMMARY OF THE INVENTION

The invention is a novel method of processing photothermographic elements which provides improved latent image stability. Photothermographic elements to which the invention is applicable are those comprising a support bearing one or more layers comprising:

(a) a photosensitive silver halide, prepared in situ or ex situ;
(b) an organic silver salt; and
(c) a reducing agent;

in concentrations such that imagewise exposure to actinic radiation generates from the silver halide a catalyst which accelerates an image-forming reaction between the organic silver salt and the reducing agent.

In accordance with the invention, the photothermographic element is processed by a method comprising the steps of:

(1) imagewise-exposing the element to actinic radiation to form a latent image therein;
(2) subjecting the imagewise-exposed element to a first heating step at a temperature and for a time sufficient to intensify the latent image but insufficient to produce a visible image, and thereafter
(3) subjecting the element to a second heating step at a temperature and for a time sufficient to produce a visible image.

The time which is allowed to elapse between steps (1) and (2) and between steps (2) and (3) is selected so as to be appropriate for the particular conditions and circumstances under which the photothermographic element is utilized. The first heating step is typically carried out in-line with the exposure step and therefore follows substantially immediately thereafter. When utilized in roll form, the photothermographic element is typically rewound after the first heating step and unwound in order to carry out the second heating step.

Latensification of conventional silver halide elements, i.e., treatment to intensify the latent image, is a well-known technique. It can be achieved by bathing the exposed element in a suitable solution or by overall exposure to low-intensity light (see "The Theory Of The Photographic Process", Edited by T. H. James, Fourth Edition, Page 177, Macmillan Publishing Co., Inc., 1977). By analogy, the procedure utilized in the present invention to intensify the latent image of a photothermographic element can be termed "thermal latensification."

DESCRIPTION OF THE PREFERRED EMBODIMENTS

The photothermographic elements utilized in this invention can be black-and-white imaging elements or dye-forming elements, including elements adapted for dye image transfer to an image receiver layer. Illustrative of the many patents describing photothermographic elements are U.S. Pat. Nos. 3,457,075, 3,764,329, 3,802,888, 3,839,049, 3,871,887, 3,933,508, 4,260,667, 4,267,267, 4,281,060, 4,283,477, 4,287,295, 4,291,120, 4,347,310, 4,459,350, 4,741,992, 4,857,439 and 4,942,115.

The photothermographic elements as described in the prior art comprise a variety of supports. Examples of useful supports include poly(vinylacetal) film, polystyrene film, poly(ethyleneterephthalate) film, polycarbonate films and related films and resinous materials, as well as glass, paper, metal, and other supports that can withstand the thermal processing temperatures.

The layers of the photothermographic element are coated on the support by coating procedures known in the photographic art, including dip coating, air knife coating, curtain coating or extrusion coating using coating hoppers. If desired, two or more layers are coated simultaneously.

Commonly utilized photothermographic elements comprise a support bearing, in reactive association, in a binder, such as poly(vinyl butyral), (a) photosensitive silver halide, prepared ex situ and/or in situ, and (b) an oxidation-reduction image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent. The photothermographic silver halide element can comprise other addenda known in the art to help in providing a useful image, such as optional toning agents and image stabilizers.

A preferred photothermographic element comprises a support bearing, in reactive association, in a binder, particularly a poly(vinyl butyral) binder, (a) photographic silver halide, prepared in situ and/or ex situ, (b) an oxidation-reduction image forming combination comprising (i) silver behenate, with (ii) a phenolic reducing agent for the silver behenate, (c) a toning agent, such as succinimide, and (d) an image stabilizer, such as 2-bromo-2-(4-methylphenylsulfonyl)acetamide.

The photothermographic element typically has an overcoat layer that helps protect the element from undesired marks. Such an overcoat can be, for example, a polymer as described in the photothermographic art. Such an overcoat can also be an overcoat comprising poly(silicic acid) and poly(vinyl alcohol) as described in U.S. Pat. No. 4,741,992.

The optimum layer thickness of the layers of the photothermographic element depends upon such factors as the processing conditions, thermal processing means, particular components of the element and the desired image. The layers typically have a layer thickness within the range of about 1 to about 10 microns.

The photothermographic element comprises a photosensitive component that consists essentially of photographic silver halide. In the photothermogaphic element it is believed that the latent image silver from the photographic silver halide acts as a catalyst for the described oxidation-reduction image-forming combination upon processing. A preferred concentration of photographic silver halide is within the range of about 0.01 to about 10 moles of silver halide per mole of silver behenate in the photothermographic element. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide are described in, for example, *Research Disclosure,* December 1978, Item No. 17643 and *Research Disclosure,* June 1978, Item No. 17029. Tabular grain photosensitive silver halide is also useful, such as described in, for example, U.S. Pat. No. 4,453,499.

The photographic silver halide can be unwashed or washed, chemically sensitized, protected against production of fog and stabilized against loss of sensitivity during keeping as described in the above Research Disclosure publications. The silver halide can be prepared in situ as described in, for example, U.S. Pat. No. 3,457,075. Optionally the silver halide can be prepared ex situ as known in the photographic art.

The photothermographic element typically comprises an oxidation-reduction image-forming combination that contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver oxidizing agents are silver behenate, silver stearate, silver oleate, silver laurate, silver caprate, silver myristate, and silver palmitate. Combinations of organic silver salt oxidizing agents are also useful. Examples of useful silver salt oxidizing agents that are not silver salts of fatty acids include, for example, silver benzoate and silver benzotriazole.

The optimum concentration of organic silver salt oxidizing agent in the photothermographic material will vary depending upon the desired image, particular organic silver salt oxidizing agent, particular reducing agent, particular fatty acids in the photothermographic composition, and the particular photothermographic element. A preferred concentration of organic silver salt oxidizing agent is typically within the range of 0.5 mole to 0.90 mole per mole of total silver in the photothermographic element. When combinations of organic silver salt oxidizing agents are present, the total concentration of organic silver salt oxidizing agents is within the described concentration range.

A variety of reducing agents are useful in the oxidation-reduction image-forming combination. Examples of useful reducing agents include substituted phenols and naphthols such as bis-beta-naphthols; polyhydroxybenzenes, such as hydroquinones; catechols and pyrogallols, aminophenol reducing agents, such as 2,4-diaminophenols and methylaminophenols, ascorbic acid, ascorbic acid ketals and other ascorbic acid derivatives; hydroxylamine reducing agents; 3-pyrazolidone reducing agents; sulfonamidophenyl reducing agents such as described in U.S. Pat. No. 3,933,508 and *Research Disclosure,* June 1978, Item No.

17029. Combinations of organic reducing agents are also useful.

Preferred organic reducing agents in the photothermographic materials are sulfonamidophenol reducing agents, such as described in U.S. Pat. No. 3,801,321. Examples of useful sulfonamidophenol reducing agents include 2,6-dichloro-4-benzenesulfonamidophenol; benzenesulfonamidophenol; 2,6-dibromo-4-benzenesulfonamidophenol and mixtures thereof.

An optimum concentration of reducing agent in a photothermographic material varies depending upon such factors as the particular photothermographic element, desired image, processing conditions, the particular organic silver salt oxidizing agent and manufacturing conditions for the photothermographic material. A particularly useful concentration of organic reducing agent is within the range of 0.2 mole to 2.0 mole of reducing agent per mole of silver in the phtotothermographic material. When combinations of organic reducing agents are present, the total concentration of reducing agents is preferably within the described concentration range.

The photothermographic material preferably comprises a toning agent, also known as an activator-toning agent or a toner-accelerator. Combinations of toning agents are useful in photothermographic materials. An optimum toning agent or toning agent combination depends upon such factors as the particular photothermographic material, desired image and processing conditions. Examples of useful toning agents and toning agent combinations include those described in, for example, *Research Disclosure,* June 1978, Item No. 17029 and U.S. Pat. No. 4,123,282. Examples of useful toning agents include phthalimide, N-hydroxyphthalimide, N-potassium phthalimide, succinimide, N-hydroxy-1,8-naphthalimide, phthalazine, 1-(2H)-phthalazinone and 2-acetyphthalazinone.

Stabilizers are also useful in the photothermographic material. Examples of such stabilizers and stabilizer precursors are described in, for example, U.S. Patent No. 4,459,350 and U.S. Pat. No. 3,877,940. Such stabilizers include photolytically active stabilizers and stabilizer precursors, azole thioethers and blocked azolinethione stabilizer precursors and carbamoyl stabilizer precursors.

Photothermographic materials preferably contain various colloids and polymers, alone or in combination, as vehicles or binding agents utilized in various layers. Useful materials are hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances, such as polyvinyl compounds like poly(vinylpyrrolidone) and acrylamide polymers. Other synthetic polymeric compounds that are useful include ispersed vinyl compounds such as in latex form and particularly those that increase the dimensional stability of photographic materials. Effective polymers include polymers of alkylacrylates and methacrylates, acrylic acid, sulfoacrylates and those that have crosslinking sites that facilitate hardening or curing. Preferred high molecular weight polymers and resins include poly(vinylbutyral), cellulose acetate butyrals, poly(methylmethacrylate), poly(vinyl pyrrolidone), ethyl cellulose, polystyrene, poly(vinyl chloride), chlorinated rubbers, polyisobutylene, butadiene-styrene copolymers, vinyl chloride-vinyl acetate copolymers, poly(vinyl alcohols) and polycarbonates.

The photothermographic materials can contain development modifiers that function as speed increasing compounds, sensitizing dyes, hardeners, antistatic layers, plasticizers and lubricants, coating aids, brighteners, absorbing and filter dyes, and other addenda, such as described in *Research Disclosure,* June 1978, Item No. 17029 and *Research Disclosure,* December 1978, Item No. 17643.

Spectral sensitizing dyes are useful in the photothermographic materials to confer added sensitivity to the elements and compositions. Useful sensitizing dyes are described in, for example, *Research Disclosure,* June 1978, Item No. 17029 and *Research Disclosure,* December 1978, Item No. 17643.

A photothermographic element, as described, also preferably comprises a thermal stabilizer to help stabilize the photothermographic element prior to imagewise exposure and thermal processing. Such a thermal stabilizer aids improvement of stability of the photothermographic element during storage. Typical thermal stabilizers are: (a) 2-bromo-2-arylsulfonylacetamides, such as 2-bromo-2-p-tolylsulfonylacetamide; (b) 2-(tribromomethyl sulfonyl)benzothiazole and (c) 6-substituted-2,4-bis(tribromomethyl)-S-triazine, such as 6-methyl or 6-phenyl-2,4-bis(tribromomethyl)-s-triazine.

The photothermographic element is imagewise exposed by means of various forms of energy. Such forms of energy include those to which the photosensitive silver halide is sensitive and include the ultraviolet, visible and infrared regions of the electromagnetic spectrum as well as electron beam and beta radiation, gamma ray, x-ray, alpha particle, neutron radiation, and other forms of wave-like radiant energy in either noncoherent (random phase) or coherent (in phase) forms as produced by lasers. Exposures are monochromatic, orthochromatic, or panchromatic depending upon the spectral sensitization of the photographic silver halide. Imagewise exposure is preferably for a sufficient time and intensity to produce a developable latent image in the photothermographic element.

Heating means known in the photothermographic art are useful for providing the desired processing temperature. The heating means is, for example, a simple hot plate, iron, roller, heated drum, microwave heating means, heated air or the like.

Thermal processing is preferably carried out under ambient conditions of pressure and humidity. Conditions outside normal atmospheric conditions can be used if desired.

The components of the photothermographic element can be in any location in the element that provides the desired image. If desired, one or more of the components of the element can be distributed between two or more of the layers of the element. For example, in some cases, it is desirable to include certain percentages of the organic reducing agent, toner, stabilizer precursor and/or other addenda in an overcoat layer of the photothermographic element.

It is necessary that the components of the imaging combination be "in association" with each other in order to produce the desired image. The term "in association" herein means that in a photothermographic element the photosensitive silver halide and the image-forming combination are in a location with respect to each other that enables the desired processing and produces a useful image.

As previously described herein, the method of this invention comprises the steps of:

(1) imagewise exposing the element to actinic radiation to form a latent image therein, (2) subjecting the imagewise-exposed element to a first heating step at a temperature and for a time sufficient to intensify the latent image but insufficient to produce a visible image, and thereafter, (3) subjecting the element to a second heating step at a temperature and for a time sufficient to produce a visible image.

In the method of this invention, the visible image is formed in the usual way, that is by uniformly heating the photothermographic element to moderately elevated temperatures, but the method differs from prior photothermographic processing methods in that it includes a prior heating step for the purpose of thermal latensification. The thermal latensification step is also carried out by uniformly heating the photothermographic element but utilizing conditions of time and temperature adapted to this purpose. The elapsed time between steps (1) and (2) is short enough that significant speed loss will not occur before the thermal latensification takes place. The elapsed time between steps (2) and (3) is typically much greater than that between steps (1) and (2) and sufficient to advantageously utilize the beneficial effect of the invention in stabilizing the latent image.

Practice of the invention involves the use of suitable image-forming apparatus for forming a visible image in a photothermographic element, such apparatus comprising exposure means for imagewise exposing the element to actinic radiation so as to form a latent image therein, first heating means for heating the element under conditions which intensify the latent image, and second heating means for heating the element under conditions which convert the intensified latent image to a visible image.

The same type of heating apparatus can be utilized in each of the first and second heating steps or different types can be chosen for each step as desired.

In the method of this invention, the elapsed time between steps (1) and (2) is typically less than ten minutes and most usually less than one minute. The elapsed time between steps (2) and (3) is, of course, a matter of choice and can vary widely. In most instances, it is a period of at least several hours. It is typically in the range of from about 1 to about 48 hours and more usually in the range of from about 6 to about 24 hours.

The temperature and time utilized in each of steps (2) and (3) is dependent upon the type of image desired, the particular components of the photothermographic element, the type of heating means employed, and so forth.

Generally speaking, the first heating step in the method of this invention is carried out at a temperature below 100° C. and the second heating step is carried out at a temperature above 100° C. In both heating steps, longer heating times are typically employed with lower processing temperatures and vice versa.

A preferred time and temperature range for the first heating step is a time in the range of from about 1 to about 30 seconds and a temperature in the range of from about 80° to about 98° C.; while a particularly preferred time and temperature range for the first heating step is a time in the range of from about 3 to about 6 seconds and a temperature in the range of from about 90° to about 95° C.

A preferred time and temperature range for the second heating step is a time in the range of from about 2 to about 10 seconds and a temperature in the range of from about 115° to about 125° C.; while a particularly preferred time and temperature range for the second heating step is a time in the range of from about 4 to about 6 seconds and a temperature in the range of from about 118° to about 120° C.

The invention is further illustrated by the following examples of its practice.

EXAMPLES 1-6

In Examples 1-3 below, the effect of post-exposure heat latensification was evaluated for the heat-developable microfilm described in Example 1 of U.S. Pat. No. 4,741,992, "Thermally Processable Element Comprising An Overcoat Layer Containing Poly(Silicic Acid", issued May 3, 1988, to Wojciech M. Przezdziecki. In Examples 4-6 below, the film employed was the same as that utilized in Examples 1-3 with the exception that the $HgBr_2$, which serves as an antifoggant, was omitted and the further exception that the concentration of monobromo stabilizer was approximately one-sixth of that specified in Example 1 of U.S. Pat. No. 4,711,992.

The data reported below illustrate the latent image keeping (LIK) characteristics of the films. The values reported are the Log E speed losses, resulting from storing the film for 24 hours at 34° C., for samples subjected to post-exposure heat latensification at temperatures of 85°, 90° and 95° C. and times of 0, 1, 3, 6, 15 and 30 seconds.

| Example No. | Temperature (°C.) | Seconds of Post-Exposure Heat Latensification | | | | | |
|---|---|---|---|---|---|---|---|
| | | 0 | 1 | 3 | 6 | 15 | 30 |
| 1 | 85 | 1.28 | 0.43 | 0.11 | 0.10 | 0.09 | 0.00 |
| 2 | 90 | 1.27 | 0.08 | 0.04 | 0.00 | 0.00 | 0.00 |
| 3 | 95 | 1.26 | 0.00 | 0.00 | 0.00 | 0.00 | 0.00 |
| 4 | 85 | 0.44 | 0.10 | 0.07 | 0.05 | 0.05 | 0.04 |
| 5 | 90 | 0.47 | 0.02 | 0.01 | 0.00 | 0.00 | 0.00 |
| 6 | 95 | 0.45 | 0.00 | 0.00 | 0.00 | 0.00 | 0.00 |

The data reported above show that where no heat latensification step was employed there were speed losses of as high as 1.28 Log E with the film containing mercury and as high as 0.47 Log E with the film in which the mercury was omitted, but that a brief post-exposure heat latensification step was completely effective in eliminating latent-image-keeping speed loss.

As shown by the above examples, the method of this invention substantially alleviates the serious problem of speed loss that commonly occurs with photothermographic elements. By utilizing this method, photothermographic elements can be kept for as long as twenty-four hours or longer before they are subjected to thermal processing to form a visible image without encountering significant speed loss. Moreover, the method of this invention is not only highly effective but simple and inexpensive to put into use.

The invention has been described in detail, with particular reference to certain preferred embodiments thereof, but it should be understood that variations and modifications can be effected within the spirit and scope of the invention.

What is claimed is:

1. A method of processing a photothermographic element to form a visible image, said element comprising a photosensitive silver halide, an organic silver salt and a reducing agent in concentrations such that imagewise exposure to actinic radiation generates from said silver halide a catalyst which accelerates an image-forming reaction between said organic silver salt and said reducing agent; said method comprising the steps of:

(1) imagewise-exposing said element to actinic radiation to form a latent image therein, (2) subjecting said element to a first heating step at a temperature and for a time sufficient to intensify said latent image but insufficient to produce a visible image, and thereafter (3) subjecting said element to a second heating step at a temperature and for a time sufficient to produce a visible image.

2. The method as claimed in claim 1 wherein the elapsed time between steps (1) and (2) is less than 10 minutes.

3. The method as claimed in claim 1 wherein the elapsed time between steps (2) and (3) is in the range of from about 1 to about 48 hours.

4. The method as claimed in claim 1 wherein the temperature in step (2) is below 100° C. and the temperature in step (3) is above 100° C.

5. The method as claimed in claim 1 wherein the temperature in step (2) is in the range of from about 80° C. to about 98° C.

6. The method as claimed in claim 1 wherein the time in step (2) is in the range of from about 1 second to about 30 seconds.

7. The method as claimed in claim 1 wherein the temperature in step (3) is in the range of from about 115° C. to about 125° C.

8. The method as claimed in claim 1 wherein the time in step (3) is in the range of from about 2 seconds to about 10 seconds.

9. The method as claimed in claim 1 wherein said organic silver salt is silver behenate.

10. The method as claimed in claim 1 wherein said reducing agent is a phenolic reducing agent.

11. The method as claimed in claim 1 wherein said photothermographic element additionally comprises a toning agent and an image stabilizer.

12. A method of processing a photothermographic element to form a visible image, said element comprising a photosensitive silver halide, an organic silver salt and a reducing agent in concentrations such that imagewise exposure to actinic radiation generates from said silver halide a catalyst which accelerates an image-forming reaction between said organic silver salt and said reducing agent; said method comprising the steps of:

(1) imagewise-exposing said element to actinic radiation to form a latent image therein;

(2) within 10 minutes after step (1) subjecting said imagewise-exposed element to a first heating step at a temperature in the range of from about 80° C. to about 98° C. and for a time in the range of from about 1 to about 30 seconds to intensify said latent image; and (3) within 1 to 48 hours after step (2) subjecting said element to a second heating step at a temperature in the range of from about 115° C. to about 125° C. and for a time in the range of from about 2 to about 10 seconds to produce a visible image.

* * * * *